United States Patent [19]

Marchesi

[11] Patent Number: 4,736,494

[45] Date of Patent: Apr. 12, 1988

[54] MAGNETIC BUTTON FOR ARTICLES OF CLOTHING, LEATHER GOODS, AND THE LIKE

[75] Inventor: Alberto Marchesi, Milan, Italy

[73] Assignee: Minu S.p.A., Cormano, Italy

[21] Appl. No.: 748,538

[22] Filed: Jun. 25, 1985

[30] Foreign Application Priority Data

Jul. 6, 1984 [IT] Italy ..... 2250 B/84[U]

[51] Int. Cl.[4] ..... A44B 21/00

[52] U.S. Cl. ..... 24/303; 24/687; 24/691; 292/251.5

[58] Field of Search ..... 411/501–504, 411/533, 368, 372, 544, 525, 526, 528, 160, 163, 165; 292/DIG. 33, 251.5; 24/620–622, 679, 680, 682, 94, 687–692, 696, 95, 303

[56] References Cited

U.S. PATENT DOCUMENTS

| | | | |
|---|---|---|---|
| 382,903 | 5/1888 | Richardson et al. | 24/689 |
| 465,271 | 12/1891 | Hyde, Jr. | 24/94 X |
| 769,780 | 9/1904 | Stirckler | 24/688 |
| 780,510 | 1/1905 | Lane | 24/687 X |
| 1,299,096 | 4/1919 | Ames | 24/303 X |
| 1,661,616 | 3/1928 | Merzinger | 24/95 X |
| 1,873,736 | 8/1932 | Braunlich | 24/690 X |
| 2,194,458 | 3/1940 | Eckler | 411/504 |
| 3,438,665 | 4/1969 | Anderson | 292/251.5 |
| 4,021,891 | 5/1977 | Monta | 292/251.5 X |
| 4,480,361 | 11/1984 | Monta | 24/303 |
| 4,555,832 | 12/1985 | Suno et al. | 24/682 |

FOREIGN PATENT DOCUMENTS

| | | | |
|---|---|---|---|
| 334780 | 1/1936 | Italy | 24/692 |
| 285030 | 8/1928 | United Kingdom | 411/544 |

*Primary Examiner*—Kenneth J. Dorner
*Assistant Examiner*—James R. Brittain
*Attorney, Agent, or Firm*—Guido Modiano; Albert Josif

[57] ABSTRACT

The magnetic button comprises magnetically cooperating male and female elements each having a rivet element for attachment to a respective flap of an article and at least one holed plate wherethrough the rivet element is passed and clamped between one face of the respective flap and an upsettable end of the rivet. The plate has a substantially crowned shape with peripheral radial cutouts defining peripheral tabs on the plate so as to enable an elastic deformation thereof.

4 Claims, 2 Drawing Sheets

MAGNETIC BUTTON FOR ARTICLES OF CLOTHING, LEATHER GOODS, AND THE LIKE

BACKGROUND OF THE INVENTION

This invention relates to a magnetic button for articles of clothing, leather goods, and the like.

As is known, there are commercially available magnetic buttons which can secure together two flaps of an article of clothing by virtue of the magnetic attraction established between two elements, usually male and female ones of cylindrical shape. Magnetic buttons of this kind are available in a variety of shapes, and various methods are used for attaching them to the article flaps. In particular U.S. patent application, Ser. No. 740,702 filed on June 3, 1985 abandoned by the same Applicant illustrates in FIG. 7 a magnetic button wherein the male element comprises a rivet shank which is passed through the article flap and upturned at one of its ends for fixing purposes, whilst the female element has, in addition to a similar upturned end, a magnetic core which generates the magnetic field attracting the male shank.

This prior embodiment has proved to be advantageous in that it affords the possibility of greatly decreasing the overall bulk of the magnetic button, and because it can be applied even where limited thicknesses are required.

SUMMARY OF THE INVENTION

It is a primary object of this invention to improve the magnetic button of the cited prior application so as to combine the reduced thickness and wide applicability features with constructional features which afford a simple and quick assembling to the article flaps.

Another object of this invention is to provide such an improved magnetic button which can be installed automatically using specially provided equipment, and no longer require the costly and time-consuming manual procedure used heretofore for the same purpose.

A further object of this invention is to provide such a magnetic button which is simple and extremely inexpensive and involves no costly procedures for its assembling.

A not least object of this invention is to provide such an improved magnetic button which has an appealing outward appearance.

These and other objects, such as will be apparent hereinafter, are achieved by a magnetic button for articles of clothing, leather goods, and the like, comprising mutually cooperating male and female elements each having a rivet element for fastening to a respective flap of an article, and a holed plate wherethrough said rivet element is passed being clamped between one face of the respective flap and the upset end of said rivet, characterized in that said plate has a substantially crowned shape with peripherally arranged radial cutouts defining peripheral tabs in said plate so as to permit elastic deformation thereof.

BRIEF DESCRIPTION OF THE DRAWINGS

Further features and advantages will become apparent from the following detailed description of a preferred embodiment of the invention, with reference to the accompanying illustrative drawings, where.

DESCRIPTION OF THE PREFERRED EMBODIMENTS

Figure 1:
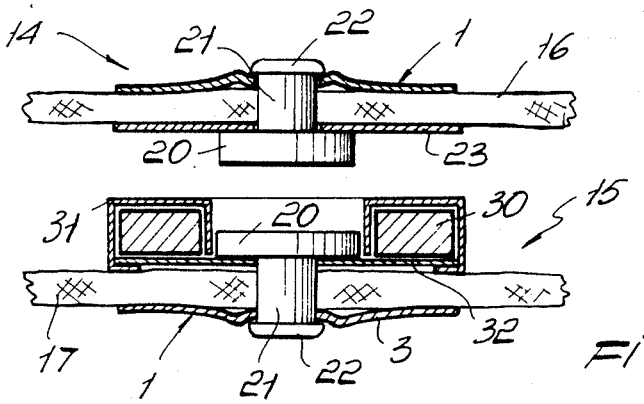
FIG. 1 is a cross-section taken through the magnetic button incorporating the plate according to the invention.

With reference to FIG. 1, the improved magnetic button of this invention comprises, in a conventional fashion, a male element 14 attached to a flap 16 of an article and a female element 15 attached to another flap 17 of the article. This improved magnetic button has a similar overall configuration to that of the button shown in FIG. 7 of the cited prior Application by the same Applicant. In detail, the male element 14 comprises essentially a rivet having a head 20, shank 21, and upsetting zone 22. Between the head 20 and fabric or hide flap of the article 16, there is interposed a small disk 23. Likewise, the female element 15 includes a rivet having a head 20, shank 21, and upsetting end 22 whereto a magnetic core 30 is affixed which is accommodated within a cap 31, adapted to be clinched on a small disk 32. The button of this invention further comprises small plates, designated with the reference numeral 1, located on the sides of the flaps 16 and 17 facing away from each other and clamped by the upset heads 22 of the rivets against such surfaces.

Figure 2:
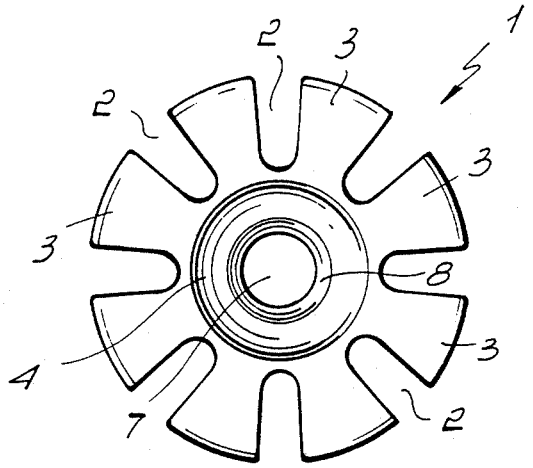
FIG. 2 is a top plan view of the inventive plate.
Figure 3:
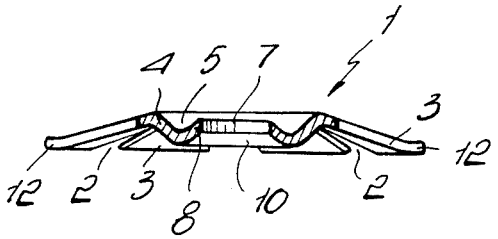
FIG. 3 is a cross-section taken through the plate of FIG. 2.

Said plates, which form the peculiar aspect of this invention, are shown more detailedly in FIGS. 2 and 3.

With reference to FIGS. 2 and 3, the plate of this invention comprises a circular disk of substantially crowned shape, as shown in the sectional view of FIG. 3. The plate 1 is divided into plural concentrical areas having individual characteristics for performing a well-defined function and obtaining particular advantages. In detail, the plate 1, is expediently formed from a substantially inelastic material such as hardened steel, and has an outermost annular zone whereat cutouts 2 are formed to define a plurality of fins or tabs 3 effective to confer on the plate compliance or elastic deformability characteristics necessitated to lock the button on the flap. The tabs 3 extend preferably over a frusto-conical surface coaxial with the plate. Advantageously, the outermost portion of the tabs 3 each define a substantially flat zone 12 extending approximately parallel to the flap of the article on which the button is to be installed, prior to its installation. This prevents the outer edge of the plate, during the fastening thereof, from digging into the fabric or hide and causing laceration thereof. Proceeding concentrically, toward the inside with respect to the zone of the tabs 3, a conical portion 4 is defined, which has an opposite taper angle and which, together with the next annular zone 8, also conical and extending more or less in the same direction as the tabs 3, defines a seat 5 for the upsetting head 22 of the rivet, as shown in FIG. 1, and as explained more fully hereinafter. The inner conical zone 8, delimiting a hole 7 for accomodating the shank 21 of the rivet, further defines (at the bottom in FIG. 3) a conical lead-in zone 10 to facilitate insertion and centering of the rivet during assembly and also to permit assembling of an automatic type.

FIGS. 4–8 show modifications of the male and female elements to which the plate shown in FIGS. 1–3 may be attached. Such elements are characterized in that the rivet and disk are made fast to each other.

Figure 4:
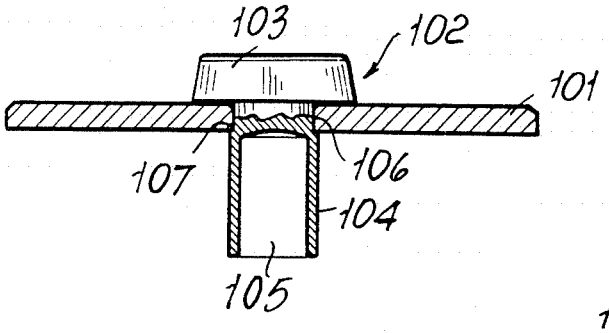
FIGS. 4–7 show fragmentary cross-sectional views across changed embodiments of the button's male element according to the invention.

In detail, with reference to FIG. 4, the male element shown comprises essentially a small disk 101 and a rivet element 102 rigidly associated with each other. In particular, the rivet element 102 comprises an enlarged head 103 and a shank portion 104. The shank 104 has an undersize zone 106 adjacent the head 103 and an oversize zone on the inside whereof there is a cavity 105, thereby a step 107 is formed between the undersize zone 106 and the remainder of the shank. That male element is obtained in this way. Initially, the rivet shank 104 has a uniform cross-section throughout its longitudinal extension, then, after being inserted into the drilled disk 101, a chamfering operation is carried out on the rivet by means of a punch penetrating the hole 105 in the shank 104 of the rivet and causing its expansion and the formation of the step 107. Upon completion of the chamfering operation, therefore, the rivet has an expanded shank zone the diameter whereof is greater than that of the hole in the disk 101 and prevents, therefore, the rivet from coming out and accordingly the permanent attachment of the rivet to the disk 101.

Figure 5:
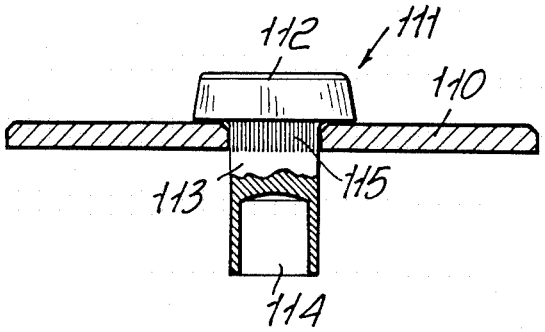

The male element according to FIG. 5 comprises a drilled disk 110 and a rivet element 111. Also in this case, the rivet 111 has a head 112 and shank 113 on the interior whereof there extend (at least part-way) a cavity 114 to allow outwards expansion of the rivet shank end. In this case, the upper portion of the shank 113, adjacent the head 112, has a knurled formation 115 which, upon force fitting the rivet shank into the hole in the disk 110, engages with the cylindrical wall of the hole in the disk 110 and prevents the rivet from coming off the disk 110. Of course, the knurled formation, instead of being provided on the rivet shank, could be provided on the wall delimiting the hole in the disk 110, to achieve the same effect.

Figure 6:
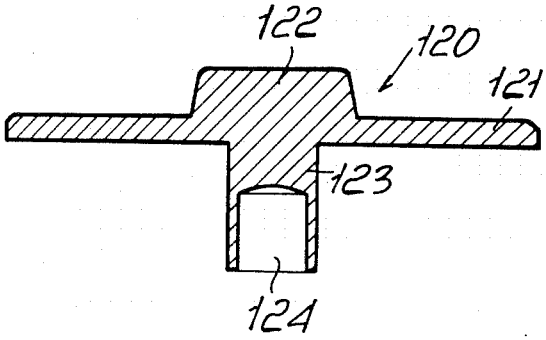

In the embodiment of FIG. 6, the disk and rivet form a single monolithic element, generally designated with the reference numeral 120. In particular, that unitary element 120 comprises a disk-like element 121 on one face whereof there extends a preferably frusto-conical projection 122 having a greater width dimension than its height, whilst the other face has a cylindrical projection portion 123 provided with a longitudinal bore 124. Both the projection 122 and cylindrical portion 123 on the other side of the disk-like element 121 are arranged centrally with respect to that disk-like element.

Figure 7:
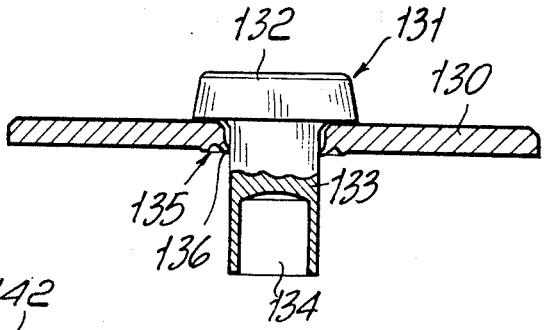

In the embodiment of FIG. 7, the rivet element 131 is of traditional shape, having a head 132, shank 133, and longitudinal cavity 134. The disk 130 has, however, a chamfered portion 135 provided with a lip 136 extending toward the shank 133 of the rivet and force-fitted adjacently the latter to retain it and prevent the rivet 131 from coming out. That element is formed from a disk of an ordinary type which is chamfered by means of a suitable punch acting on the annular dimpled zone of the disk to cause displacement of material and the formation of the retining lip 136 for the rivet shank.

Figure 8:
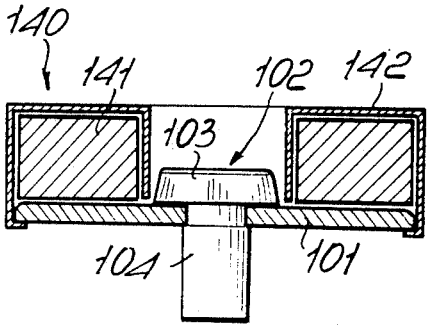
FIG. 8 is a cross-sectional view through a changed embodiment of the female member of the button according to the invention.

FIG. 8 shows the female element obtained from the male element fabricated as in FIG. 4. That female element has, accordingly, a disk 101 and a rivet 102 provided with a head 103 and a chamfered shank 104 having an undersize portion through the disk and an oversize portion which prevents the rivet from coming out. The female element 140 is then completed by a magnetic core 141 and a clenching cap 142, of a traditional type. However, it would also be possible to form a female element from the embodiments of FIGS. 5–7.

During assembly, after placing the plate 1 against one side of to flap whereto the button is to be attached and after centering the plate at the opposite side of the flap, the rivet is inserted into the disk 23, 32, thereafter the rivet with the disk 23, 32 thereon is passed through the related flap, 16 or 17 (which may be previously holed at the more or less precise location), and through the hole 7 of the plate 1 then rivetting is performed by upsetting its end 22. Thereby, the plate 1 is pressed against its respective flap and deformed to widen and adapt to the form and consistency of the flap fabric or hide. During this operation, the upset, widened head 22 of the rivet is positioned at the groove 5, thereby the rivet as a whole will barely protrude beyond the thickness of the plate 1 or may even be flush therewith.

Assembling is even simpler in the instance where the male and female elements are embodied as shown in FIGS. 4–8. In this instance, in fact, it is only required that the rivet-disk combination be passed through the related attachment flap, and the plate 1 thus saving one operation in the attachment step. This advantage is much more significant in the instance of the female element, where problems could be encountered due to the magnetic interaction of the rivet and magnetic core at the time of inserting the rivet.

As may be appreciated from the above description, the invention fully achieves its objects. In fact, a magnetic button has been provided which, by virtue of the elasticity and compressibility of the plate has very little bulk, especially if compared to the magnetic buttons which include tabs attached to either the male or female element and passed through the attachment flap to be folded over during assembly. The elasticity and compliance of the plate of this invention allow the latter to flatten itself against the flap and fit so as to accommodate unavoidable variations in thickness and consitency of the application material. Furthermore, as already explained, the provision of the flat zone 12 at the edges ensures perfect spreading of the plate and adaptation to the fabric without digging into the fabric in any circumstances, even if the plate is not positioned exactly parallel to the flap to which it is to be attached.

The fact, moreover, that the plate has a conical lead-in or invitation zone 10 ensures perfect centering of the rivet and plate, thus enabling the use of automatic machinery for assembling.

Finally, the presence of the groove 5 in the face not adjacent to the flap forming a seat for the rivet upsetting zone enables the overall thickness of the button to be decreased.

Further, the button so constructed is aesthetically pleasing, as well as being inexpensive by virtue of its extreme simplicity.

The materials used, as well as the dimensions, may be any ones contingent on requirements.

I claim:

1. A mangetic button for fastening together at least one flap-like member and at least one other flap-like member in articles of clothing, leather goods and the like said magnetic button comprising at least one male element, at least one female element at least one plate and at least one other plate, said plate and said other plate each having formed therein at least one hole, said male element comprising a rivet having a male shank, a male head, and a male upsetting zone, and at least one disk having formed therein at least one hole, said female element comprising a rivet having a female shank, a female head, a female upsetting zone, a cap having formed therein at least one through hole and a magnetic core, said male shank being inserted through said at least one hole formed in said disk, through said at least one flap-like member and through said hole formed in said at least one plate, said flap-like member having one face and another face, said disk being interposed between said male head and said one face of said at least one flap-like member, said male upsetting zone being upset at said other face of said flap-like member, said at least one plate being interposed between said male upsetting zone and said other face of said flap-like member, said female shank being inserted through said through-hole formed in said cap, through said at least one other flap-like member and through said hole formed in said other plate, said at least one other flap-like member having a first face and a second face, said cap being interposed between said female head and said first face of said at least one other flap-like member and having rigidly associated therewith said magnetic core, said female upsetting zone being upset at said second face of said other flap-like member, said at least one other plate being interposed between said female upsetting zone and said other flap-like member, said magnetic core generating a magnetic field for magnetically attracting said disk to said cap for selectively fastening said at least one flap-like member to said at least one other flap-like member, said at least one plate and said at least one other plate each including an outer edge and means for preventing said outer edge from lacerating a flap-like member whereto at least a portion of said magnetic button is attached in use and wherein said at least one plate and said at least one other plate each comprise;

means for facilitating insertion and centering of said rivet in said hole and;

means for at least partially accommodating said upsetting zone of said rivet and wherein said means for facilitating insertion and centering of said rivet in said hole comprise a conical lead-in zone, and wherein said means for at least partially accommodating said upsetting zone of said rivet comprises a conical zone, a further annular zone, and a seat, said conical lead in zone being downwardly peripherally defined around said hole, said further annular zone being upwardly peripherally defined around said hole, said conical zone extending concentrically outwards with respect to said further annular zone, said seat being defined by said further annular zone and said conical zone.

2. A magnetic button for fastening together at least one flap-like member and at least one other flap-like member in articles of clothing, leather goods and the like said magnetic button comprising at least one male element, at least one female element at least one plate and at least one other plate, said plate and said other plate each having formed therein at least one hole, said male element comprising a rivet having a male shank, a male head, and a male upsetting zone, and at least one disk having formed therein at least one hole, said female element comprising a rivet having a female shank, a female head, a female upsetting zone, a cap having formed therein at least one through hole and a magnetic core, said male shank being inserted through said at least one hole formed in said disk, through said at least one flap-like member and through said hole formed in said at least one plate, said flap-like member having one face and another face, said disk being interposed between said male head and said one face of said at least one flap-like member, said male upsetting zone being upset at said other face of said flap-like member, said at least one plate being interposed between said male upsetting zone and said other face of said flap-like member, said female shank being inserted through said through-hole formed in said cap, through said at least one other flap-like member and through said hole formed in said other plate, said at least one other flap-like member having a first face and a second face, said cap being interposed between said female head and said first face of said at least one other flap-like member and having rigidly associated therewith said magnetic core, said female upsetting zone being upset at said second face of said other flap-like member, said at least one other plate being interposed between said female upsetting zone and said other flap-like member, said magnetic core generating a magnetic field for magnetically attracting said disk to said cap for selectively fastening said at least one flap-like member to said at least one other flap-like member, said at least one plate and said at least one other plate each further comprising a disk-like element of substantially crowned shape and defining an outer edge, means for imparting to said disk-like element characteristics of elastic deformability, means for facilitating insertion and centering of said rivet in said hole and;

means for at least partially accommodating said upsetting zone of said rivet and wherein said means for facilitating insertion and centering of said rivet in said hole comprise a conical lead-in zone, and wherein said means for at least partially accommodating said upsetting zone of said rivet comprises a conical zone, a further annular zone, and a seat, said conical lead-in zone being downwardly peripherally defined around said hole, said further annular zone being upwardly peripherally defined around said hole, said conical zone extending concentrically outwards with respect to said further annular zone, said seat being defined by said further annular zone and said conical zone.

3. A magnetic button for fastening together at least one flap-like member and at least one other flap-like member in articles of clothing, leather goods and the like said magnetic button comprising at least one male element, at least one female element at least one plate and at least one other plate, said plate and said other plate each having formed therein at least one hole, said male element comprising a rivet having a male shank, a male head, and a male upsetting zone, and at least one disk having formed therein at least one hole, said female element comprising a rivet having a female shank, a female head, a female upsetting zone, a cap having formed therein at least one through hole and a magnetic core, said male shank being inserted through said at least one hole formed in said disk, through said at least one flap-like member and through said hole formed in said at least one plate, said flap-like member having one face and another face, said disk being interposed between said male head and said one face of said at least one flap-like member, said male upsetting zone being upset at said other face of said flap-like member, said at least one plate being interposed between said male upsetting zone and said other face of said flap-like member, said female shank being inserted through said through-hole formed in said cap, through said at least one other flap-like member and through said hole formed in said other plate, said at least one other flap-like member having a first face and a second face, said cap being interposed between said female head and said first face of said at least one other flap-like member and having rigidly associated therewith said magnetic core, said female upsetting zone being upset at said second face of said other flap-like member, said at least one other plate being interposed between said female upsetting zone and said other flap-like member, said magnetic core generating a magnetic field for magnetically attracting said disk to said cap for selectively fastening said at least one flap-like member to said at least one other flap-like member, said at least one plate and said at least one other plate each including an outer edge and means for preventing said outer edge from lacerating a flap-like member whereto at least a portion of said magnetic button is attached in use and wherein said at least one plate and said at least one other plate each further comprise;

a disk-like element of substantially crowned shape and defining said outer edge, means for imparting to said disk-like element characteristics of elastic deformability, means for facilitating insertion and centering of said rivet in said hole and;

means for at least partially accommodating said upsetting zone of said rivet, wherein said means for imparting to said disk-like element characteristics of elastic deformability comprise an annular zone, a plurality of cutouts and a plurality of tabs, and wherein said means for preventing said outer edge of said disk like element from lacerating a flap-like member whereto at least a portion of said magnetic button is attached comprise a plurality of substantially flat zones, wherein said means for facilitating insertion and centering of said rivet in said hole comprise a conical lead-in zone, and wherein said means for at least partially accommodating said upsetting zone of said rivet comprises a conical zone, a further annular zone, and a seat, said conical lead-in zone being downwardly peripherally defined around said hole, said further annular zone being upwardly peripherally defined around said hole, said conical zone extending concentrically outwards with respect to said further annular zone, said seat being defined by said further annular zone and said conical zone, said plurality of cutouts being formed in said annular zone, said plurality of tabs being defined between said cutouts, each tab in said plurality of tabs having an outermost portion, each substantially flat zone in said plurality of substantially flat zones being defined at said outermost portion of one of said plurality of tabs and extending approximately parallel to said flap-like member whereto said at least a portion of said magnetic button is attached in use.

4. In a magnetic button for fastening together at least one flap-like member and at least one other flap-like member in articles of clothing, leather goods and the like, a plate comprising:

a disk-like element of substantially crowned shape, having formed therein at least one hole, and defining an outer edge, means for imparting to said disk-like element characteristics of elastic deformability, means for preventing said outer edge of said disk-like element from lacerating a flap-like member whereto at least a portion of said magnetic button is attached in use, means for facilitating insertion and centering of a rivet having an upsetting zone in said hole and;

means for at least partially accommodating said upsetting zone of said rivet, wherein said means for facilitating insertion and centering of said rivet in said hole comprise a conical lead-in zone, and wherein said means for at least partially accommodating said upsetting zone of said rivet comprises a conical zone, a further annular zone, and a seat, said conical lead in zone being downwardly peripherally defined around said hole, said further annular zone being upwardly peripherally defined around said hole, said conical zone extending concentrically outwards with respect to said further annular zone, said seat being defined by said further annular zone and said conical zone.

* * * * *